United States Patent [19]

Biasini

[11] 4,372,518

[45] Feb. 8, 1983

[54] MUSIC STAND EXTENDER

[75] Inventor: Americole R. Biasini, Bellingham, Wash.

[73] Assignee: Allsop, Inc., Bellingham, Wash.

[21] Appl. No.: 101,878

[22] Filed: Dec. 10, 1979

Related U.S. Application Data

[63] Continuation-in-part of Ser. No. 916,204, Jun. 16, 1978, Pat. No. 4,312,490.

[51] Int. Cl.[3] ..... A47B 19/00

[52] U.S. Cl. ..... 248/441 R

[58] Field of Search ..... 248/448, 542, 441 R; 211/135, 175; 108/65, 69

[56] References Cited

U.S. PATENT DOCUMENTS

| | | | |
|---|---|---|---|
| 561,454 | 6/1896 | Thieler | 248/448 X |
| 575,729 | 1/1897 | Palmer | 248/448 |
| 758,924 | 5/1904 | Law | 248/448 |
| 1,037,233 | 9/1912 | Furrow | 248/448 |
| 1,071,428 | 8/1913 | Jones | 248/448 |
| 1,515,058 | 11/1924 | Lindhe | 211/50 |
| 1,542,495 | 6/1925 | Ebert | 211/51 |
| 1,651,471 | 12/1927 | Sawyer | 248/448 |
| 1,818,717 | 8/1931 | Kliegl | 248/448 |
| 1,959,843 | 5/1934 | Sprague | 248/448 |
| 2,538,318 | 1/1951 | Mitchell | 248/448 |
| 3,021,637 | 2/1962 | Huffman | 248/441 R |
| 3,076,285 | 2/1963 | Sparkman | 248/448 |
| 4,037,815 | 7/1977 | De Lano | 248/542 |
| 4,312,490 | 1/1982 | Biasini | 248/542 |

*Primary Examiner*—William H. Schultz

*Attorney, Agent, or Firm*—Hughes, Barnard & Cassidy

[57] ABSTRACT

A device to extend the support area of a music stand, where the music stand comprises a lower horizontally extending support member having a support flange to engage the lower edge of music sheets, an upstanding central main support bar, and a plurality of collapsible support struts. The present invention comprises a separate upper support section adapted to be mounted to the central support bar and having two laterally extending upper arms. There are a pair of extension wings slide mounted to the stand, with each wing having a lower flange and retaining portion engaging the lower support member of the stand, and an upper retaining portion engaging a related one of the support arms. The two extension wings can be moved toward one another to a middle position, and can be moved slideably to an extended position to provide increased support area. In a second embodiment, the stand is adapted to be mounted from a table top.

25 Claims, 10 Drawing Figures

FIG. 9
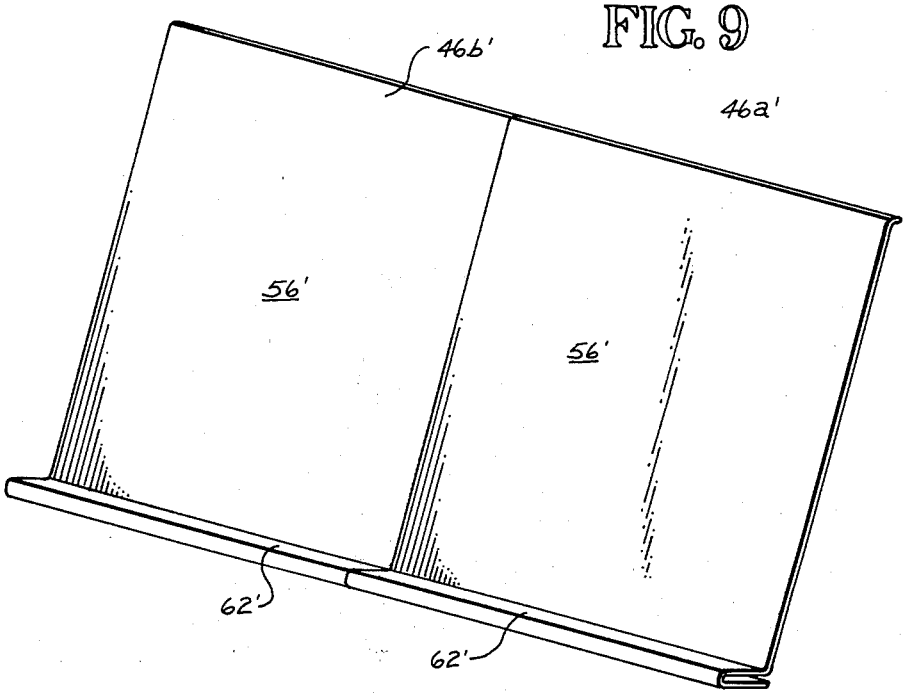
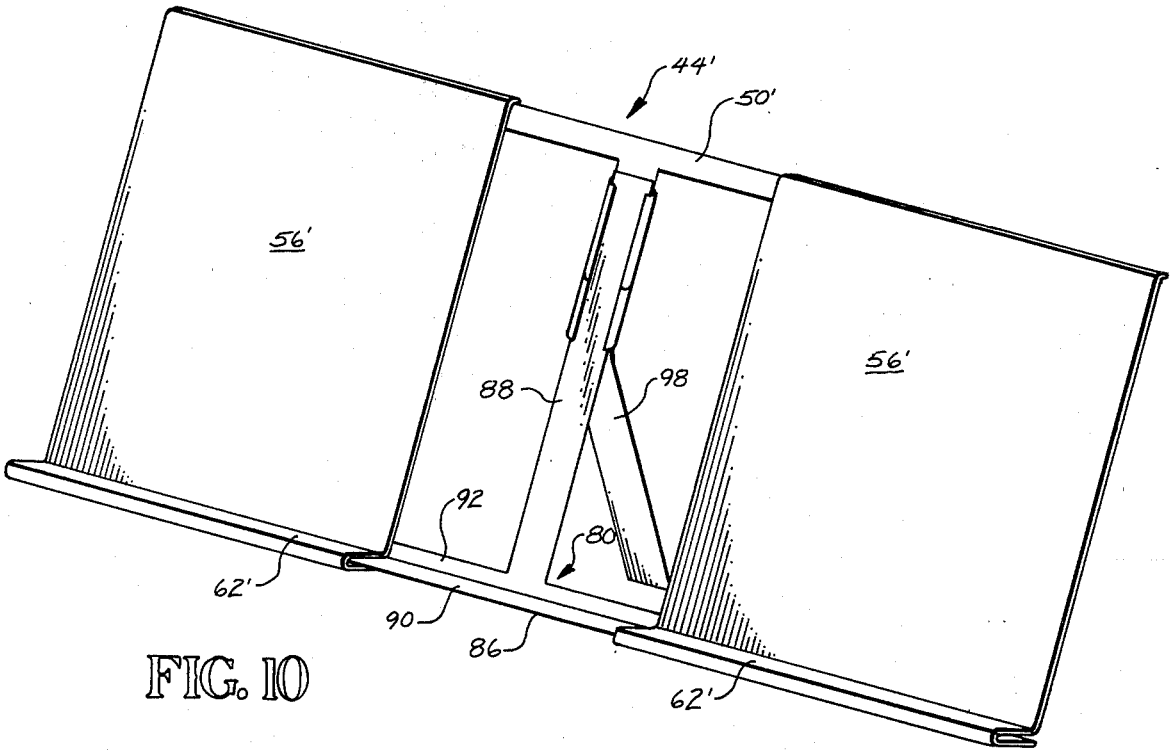
FIG. 10

MUSIC STAND EXTENDER

CROSS REFERENCE TO RELATED PATENT APPLICATIONS

This application is a continuation-in-part of U.S. application Ser. No. 916,204, filed June 16, 1978 now U.S. Pat. No. 4,312,490 entitled "Music Stand Extender."

BACKGROUND OF THE INVENTION

The present invention relates to music stands, and more particularly to a device to extend the support area of a conventional music stand.

Musicians who must perform from sheet music have been confronted with the problem of using music stands which have been constructed for holding a single book of sheet music, so that when it is necessary to utilize two or more books of music, or an overly large book of music, one must place two music stands side by side in order to accommodate the material. This results in a maze of music stands, often in an orchestra or other situation where there is very little available space, as well as the need for a large number of music stands, often at considerable expense. Thus, there is the need for a device which will provide an enlarged support area for sheet music, while at the same time taking advantage of the large number of conventional music stands now in use.

One type of extensible music stand is shown in the prior art in U.S. Pat. No. 1,818,717, Kliegl, which illustrates a stand having an adjustable music rest which normally provides space for a single sheet of music, but which may be expanded nominally beyond that width when the necessity arises. The back plate of the music rest has its side and lower edges turned upwardly, which forms an enclosed box-like area with the hooded lamp which comprises the upper edge. The forward, upward edge of each wall is turned in the form of a bead to enclose and grip a portion of a circular wire or rod, which is bent in two directions to provide a horizontal plunger-like portion which enters the bead. This permits the side walls to be moved horizontally to and from the sides of the music rack.

U.S. Pat. No. 1,037,233, Furrow, illustrates another music-desk construction for attachment to a pianoforte. The adjustable desk is composed of three panels, a center panel and two side panels attached thereto. Lateral tongues in the side panels interfit with a dove-tailed groove in the center panel which allow the side panels to be adjusted laterally to increase the width of the desk. The assembly is provided with a plurality of lugs and brackets which attach the desk to a pianoforte.

As other examples of the prior art, U.S. Pat. No. 2,538,318, Mitchell, illustrates a copy holder which may be adjusted to accommodate sheets of different widths. There is a fixed section to the copyholder which has a flange on one side and lower and upper flanges, each with inwardly extending ribs forming a guide. The adjustable section slides over the back of the fixed section and is provided with flanges which slide in the open end of the guideway of the flanges on the fixed section. The adjustable section is retained in adjustable position by a detent in a rib provided on the fixed section. The lower flanges of the fixed and adjustable sections provide means to hold a copy on the two sections when the copyholder is in its expanded or unexpanded position. The width of the copyholder is increased by simply pulling the adjustable section laterally and sliding it within the guides provided by the flanges of the fixed section. The copyholder is also provided with a plurality of adjustable legs.

U.S. Pat. Nos. 1,452,495, Ebert, and 1,515,058, Lindhe, disclose adjustable racks for holding pamphlets or sheets of paper. In each case there is a back plate upon which laterally move a pair of extension arms, one to the left and one to the right. There may also be vertically extensible members in addition to the laterally extensible arms. Flanges at the outermost end of each arm retain the material to be held thereon.

U.S. Pat. No. 1,651,741, Sawyer, illustrates a device to maintain a large card in a flat or substantially flat condition, wherein a strip or bar of sheet metal has its longitudinal edges inturned such that the inturned edges interfit in sliding relationship with a coupler which is secured to a base plate. Any number of the sheet metal extenders may be connected one to another by using the couplers to provide a card holder of any appropriate size.

U.S. Pat. Nos. 3,021,637, Huffman, and 1,959,843, Sprague, are further examples of prior art supporting devices.

While all of these devices may function as described, there is a need for an apparatus which may be purchased separately for addition to an existing music stand, thereby avoiding the expense of purchasing additional complete music stands.

SUMMARY OF THE INVENTION

The extension apparatus of the present invention is adapted to enlarge the support area of a stand, such as a music stand, where the stand has a main central support member and a lower support member extending laterally from the central support member. The apparatus comprises an upper support section adapted to be mounted to the stand at an upper end thereof. The support section comprises two laterally and oppositely extending support arms.

The apparatus further comprises a pair of extension wings adapted to be mounted to the stand and to the upper support section. Each wing comprises a panel portion, a lower support flange means adapted to be positioned against the lower support member of the stand, a lower retaining portion adapted to engage the lower support member to permit lateral slide motion between the wing and the lower support member, and an upper retaining portion adapted to engage a related support arm to permit slide motion between the wing and the related support arm. Thus, with the upper support section mounted to the stand, and with each of the extension wings mounted to the stand and to the upper support section, the two wings can be moved horizontally inward to a middle position, or horizontally outwardly to an expanded position to provide an expanded support area for the stand.

In the preferred form, the support section comprises a mounting leg having securing means thereon and adapted to be connected to the main central support member of the stand. More specifically, the securing means comprises a pair of retaining lips adapted to releasably engage edge portions of the support member.

The upper retaining portion of each of the extension wings desireably comprises an upward retaining flange defining a retaining slot to receive a related one of the support arms. In the preferred form, each of the retaining flanges and its related arm is provided with mating stud and slot means to provide a sliding stud and slot connection between the arms and the retaining flanges.

The preferred form of the lower retaining portion is that it comprises a lower retaining flange positioned below the support flange means and defining with the support flange means a lower slot to receive a support flange of the lower support member of the stand. Desireably, the lower retaining portion further comprises an upstanding lip secured to a rear portion of the retaining flange, with the retaining flange and the lip defining an angle slot to receive the lower support member of the stand.

In a second embodiment of the present invention, there is a music stand assembly particularly adapted for use as a table mounted stand assembly. The stand assembly is characterized in that it can be expanded to enlarge a support area of the stand assembly.

In this second embodiment, in addition to the upper support section and two wings of the first embodiment, there is a main support member comprising a lower horizontal support member and a support bar extending upwardly from the lower horizontal support member. The lower support member has a horizontal support flange adapted to support a lower edge portion of an object. The lower retaining portion of the two wings engage the lower horizontal support member, and the upper retaining portions of the two wings engage the support arms. The manner in which the two wings can be expanded or moved toward a middle position is substantially the same as in the first embodiment. Additionally, a support leg can be attached to the main support member to provide a stable assembly that can conveniently be mounted to a table top.

BRIEF DESCRIPTION OF THE DRAWING

FIG. 9 illustrates the second embodiment of the present invention where two extension wings have been mounted to the apparatus of FIG. 8, with the two extension wings being in their middle non-extended position; and FIG. 10 is a view similar to FIG. 9, but showing the two extension wings slid outwardly to their expanded position.

DESCRIPTION OF THE PREFERRED EMBODIMENTS

Figure 1:
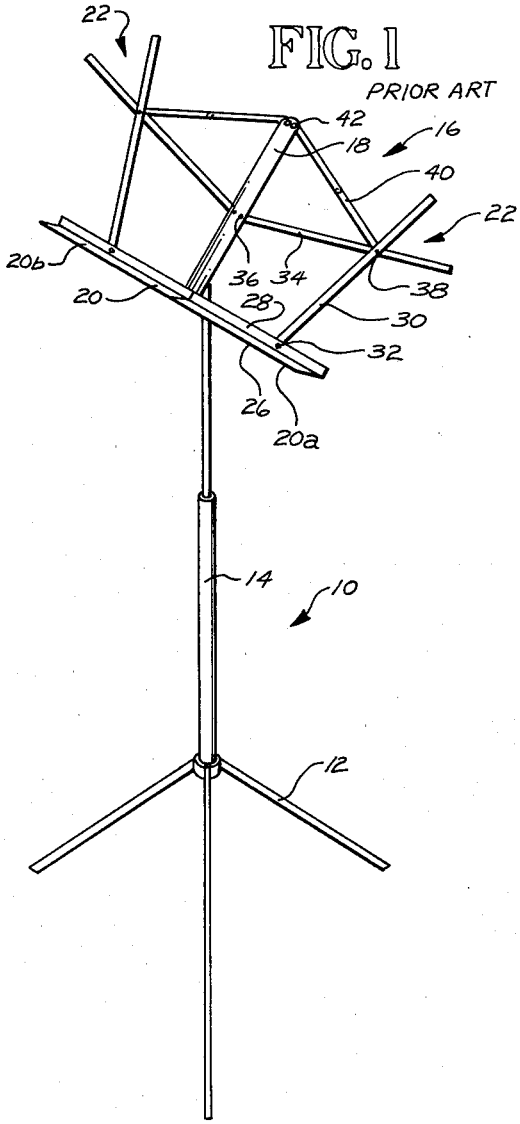
FIG. 1 PRIOR ART
FIG. 1 is an isometric view of a conventional prior art music stand for which the present invention is adapted for use.

In FIG. 1, there is shown a typical prior art music stand 10 of the type for which the present invention is particularly adapted for use. This stand 10 comprises a lower tripod 12 which supports an upwardly extending telescoping support rod 14. The music book support structure 16 is mounted to the upper end of the rod 14. The support structure 16 comprises a main central support bar 18, a lower horizontally extending support member 20, and two sets of support struts 22 connected between the bar 18 and lower member 20.

For convenience in describing the support structure 16, even though in its operating position the plane of the support structure 16 is slanted from the vertical, the "vertical axis" will be considered as being coincident with the longitudinal axis of the main central support bar 18 which extends upwardly from the lower support member 20. The term "lateral" or "horizontal" will be used with reference to an axis which is parallel to the longitudinal axis of the lower support member 20.

Figure 4:
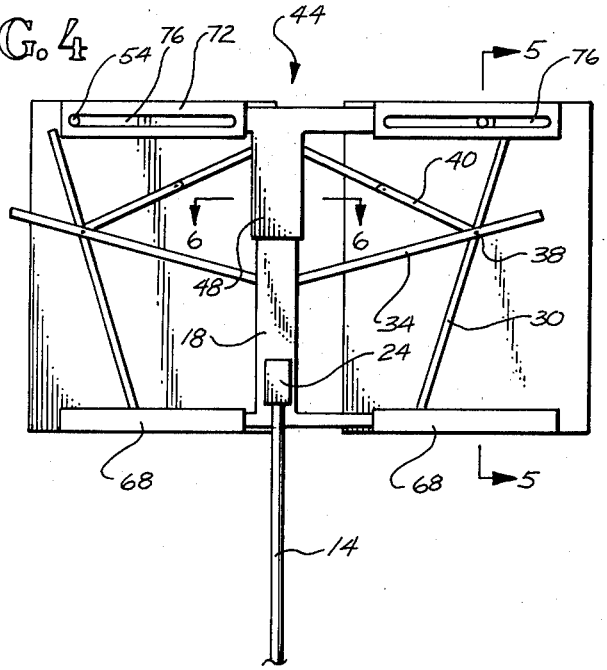
FIG. 4 is a rear elevational view of the back side of the apparatus of FIG. 3.
Figure 6:
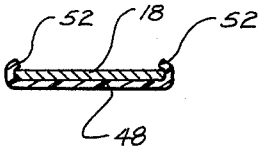
FIG. 6 is a sectional view taken along line 6—6 of FIG. 4.

With reference to FIG. 4, it can be seen that the lower rear side of the support bar 18 has a mounting socket 24 to receive the upper end of the telescoping rod 14, so that the lower support member 20 and the two sets of support struts 22 are in turn supported from the main central support bar 18. The lower support member 20 is formed as separate right and left sections **20*a* and 20*b*, respectively, which are pivotally mounted to the lower end of the bar 18. In the normal use position, the two side portions 20*a* and 20*b* are parallel and in effect form one substantially continuous support member 20**.

The support member 20 comprises a horizontally extending support flange 26, and a vertical lip portion 28 made integral with, and extending upwardly from, the rear edge of the support flange 26. (This can be seen more clearly in FIG. 5). Each set of support struts 22 comprises an outside strut 30 pivotally connected by its lower end at 32 to a related support member section **20*a* or 20*b*. There are a pair of intermediate struts 34, pivotally connected by inner ends thereof at 36 to the main support bar 18, and also pivotally connected near outer end portions at 38 to the outside struts 30. Finally, each set of struts comprises a collapsible knee strut 40, pivotally connected by one end to the pivot location 38, and by the opposite end to the upper end 42 of the main central bar 18**.

The music stand 10 is shown in its expanded use position in FIG. 1. In that position, the front surface of the bar 10 and the front surface portions of the two sets of struts 22 collectively define a vertical support plane against which the music book or music sheets may rest. The rear lip 28 is positioned generally in that same support plane, while the support flange 26 extends forwardly to provide a platform to support the lower edge of the music book.

It is to be understood that the components of the music stand 10 which have been described thus far already exist in the prior art. Normally, this music stand would be made of such a size that the total length of the lower support member 20 would be approximately 16 inches, and the total width dimension measured from the extreme outer ends of the struts 34 would be approximately 22 inches. The type of music stand shown in FIG. 1 can be collapsed and stored in a very small package, and it has been found to be a very popular type of music stand. However, to the best knowledge of the applicant herein, prior to the present invention, it has not been possible to provide a relatively inexpensive and convenient device for utilizing the basic music stand of FIG. 1 in a manner that the support area can be substantially expanded to support, for example, two music books at the same time, or to support sheet music which extends over a support area substantially in excess of that provided by the music stand of FIG. 1. As will be disclosed more fully below, the present invention provides a very convenient apparatus which permits the support area of that stand to be substantially expanded.

The first embodiment of the present invention comprises three main components, mainly an upper support section 44, and right and left extension wings 46*a* and 46*b*. The main function of the two extension wings 46*a* and 46*b* is to provide expanded support area for the music stand, while the main function of the upper support section 44 is to provide support for the upper portions of the wings 46*a* and 46*b*.

The support section 44 has a general "T" configuration, and comprises a middle mounting leg 48 adapted to be attached to the main support bar 18, and an upper arm structure 50 made up of right and left arm portions 50*a* and 50*b*, respectively. The middle mounting leg 48 is conveniently made as a flat piece of plastic having about the same width dimension as the bar 18. The side portions of the mounting leg 48 are provided with moderately flexible gripping lips 52 to releasably engage the side edge portions of the main bar 18. The two arm portions 50*a* and 50*b* extend laterally about the same distance as the lower support member 20. At the outer end of each arm portion 50*a* or 50*b*, there is a protrusion or stud 54 which extends rearwardly approximately a quarter of an inch.

Figure 5:
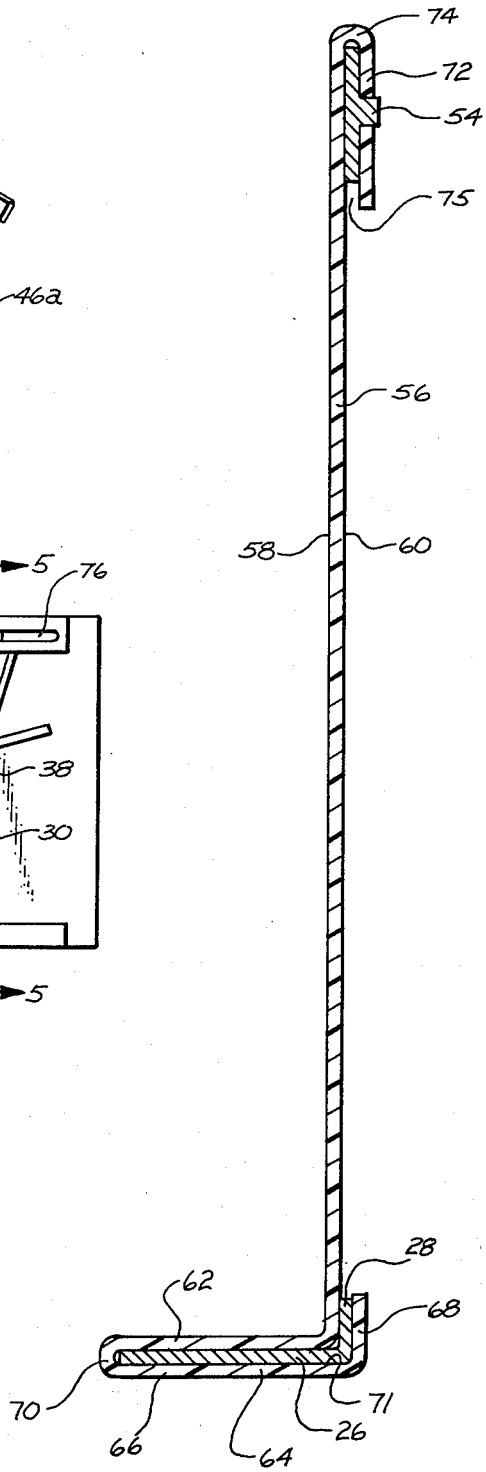
FIG. 5 is a sectional view taken along line 5—5 of FIG. 4.

To describe the configuration of each extension wing 46*a* or 46*b*, reference is made to FIG. 5. Since the two wings 46*a* and 46*b* are substantially identical in this particular embodiment, only the right wing 46*a* will be described in detail.

As shown in FIG. 5, the wing 46*a* comprises a main planar support panel 56 having a front side 58 and a backside 60. Extending forwardly from the lower edge of the panel 56 is a support flange 62. Connected to the front edge of the support flange 62 and positioned a short distance below is a lower retaining member 64. This retaining member 64 comprises a lower horizontal retaining flange 66, and a rear upwardly extending retaining lip 68. The forward end of the retaining flange 66 is connected by a rounded portion 70 to the support flange 62. The retaining flange 66 and retaining lip 68 are spaced a short distance from the support flange 62 and the lower portion of the panel 60, so as to define a right angle slot 71 having substantially the same configuration and dimensions as the lower support member 20. Thus, with the extension wing 46*a* mounted to the support structure 16, a related portion of the lower support member 22 is received in the right angle slot 71 defined at the lower edge of the wing 46*a*. In a similar manner, the other extension wing 46*b* receives the other end portion of the lower support member 20.

At the upper edge of the panel 56, there is an upper retaining flange 72 connected by an upper rounded connecting portion 74 to the upper edge of the panel 56. This upper retaining flange 72 is spaced rearwardly from the rear surface 60 of the panel 56 to define an upper receiving slot 75 having substantially the same dimensions as the arm structure 50 of the upper support section 44. Also, the retaining flange 72 has an elongate horizontal slot 76 extending a substantial length of the upper retaining flange 72 to receive the stud 54.

To describe the operation of the present invention, let it be assumed that the music stand 10 has been erected to its use position as shown in FIG. 1. First, the upper support section 44 is mounted to the upper end of the bar 18 by pressing the middle mounting leg 48 against the upper rear surface of the bar 18 so that the two gripping lips 52 snap over the outside edges of the bar 18. Next, the two extension wings 46*a* and 46*b* are mounted to the support structure 16 of the stand 10, this being accomplished by the upper arm structure 50 sliding into the upper slot 75, and the lower support member 20 sliding into the lower slot 71. When the arm structure 50 is moved into the slot 75, the upper retaining flange 72 can be sprung outwardly to a moderate extent so that the stud 54 can be slipped into the slot 76.

Figure 2:
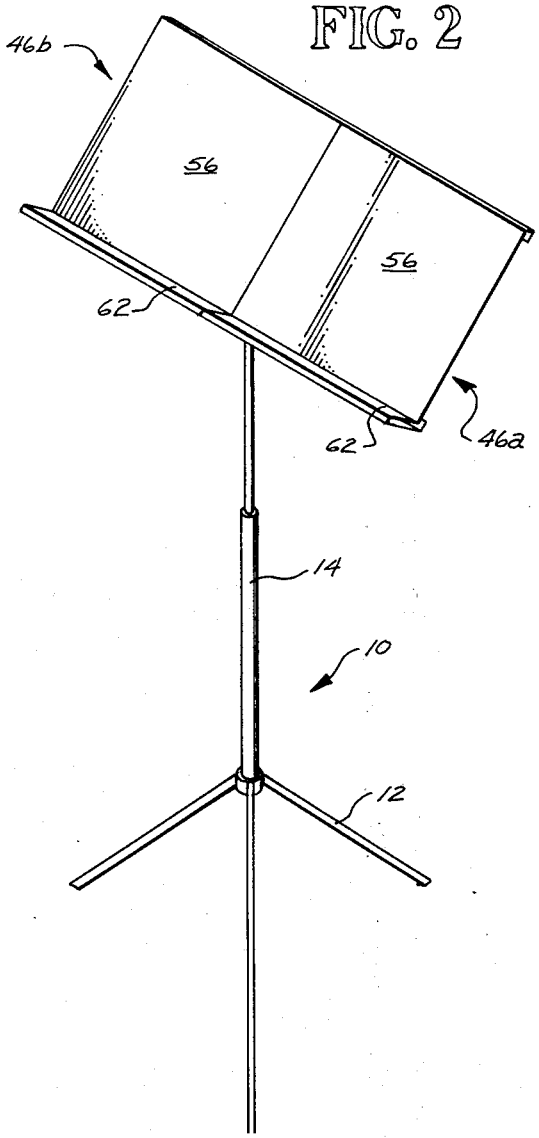
FIG. 2 is a view similar to FIG. 1, showing two extension wings of the present invention mounted to the prior art stand of FIG. 1, with the extension wings being positioned centrally in their non-extended position.
Figure 3:
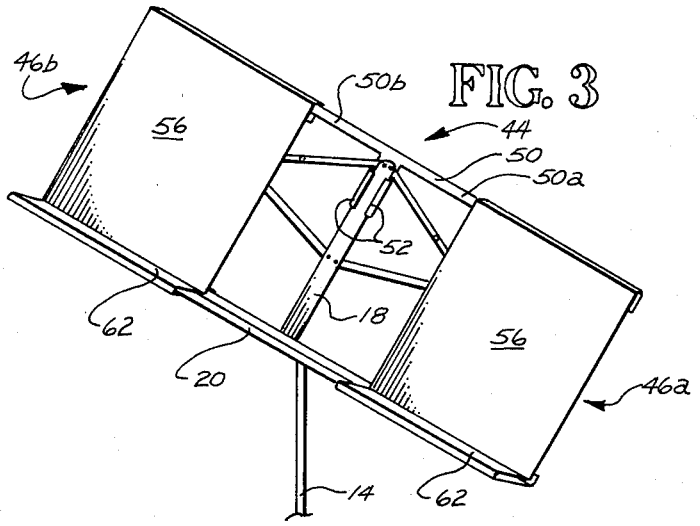
FIG. 3 is a view similar to FIG. 2, showing the extension wings of the present invention in their extended position.

With the two extension wings 46*a* and 46*b* mounted to the support structure 16, these can be slid inwardly to the position shown in FIG. 2. This would be done, for example, in a situation where the extra support area is not needed, and it is preferable to have the stand 10 erected in a more compact area. However, under those circumstances where increased support area is needed, the two extension wings 46*a* and 46*b* can be slid outwardly to the position shown in FIG. 3. The lower retaining member 64 and support flange 62 cooperate to properly secure the lower portion of each wing 46*a* or 46*b* to the lower support member 20. With these components providing the right angle slot 71, only lateral slide movement is permitted between the extension wing 46*a* or 46*b* and the lower support member 20.

The upper retaining flange 72 and the upper portion of the panel 56 cooperate to secure the upper portion of the panel 56 to the upper support arm 50. Each of the studs 54, fitting in a related slot 76, prevents relative vertical movement between the panel 56 and arm structure 50 to make the mounting of the extension wings 46*a* and 46*b* more secure. Additionally, each stud 74 acts as a stop member to prevent the extension wings 46*a* and 46*b* from being pulled too far out where they might slip entirely off the support structure 16.

The disassembly of the apparatus of the present invention can be accomplished just as easily as the assembly. When disassembled, the conventional stand 10 can be collapsed into a small package, and the two wing sections 46*a* and 46*b*, with the upper support section 44 can be stacked in a relatively compact place for storage or movement to another location.

In a typical configuration, the lateral dimension of each extension wing 46*a* and 46*b* can be made between 11 and 12 inches. In the fully extended position, each extension wing 46*a* and 46*b* can be moved out as much as 5 inches. Thus, it can be recognized that the total horizontal dimension of the support area can be as great as 32 to 34 inches in that particular configuration.

A second embodiment of the present invention will now be described with reference to FIGS. 7 through 10. Components of the second embodiment which are similar to those of the first embodiment will be given like numerical designations, with a prime (') distinguishing those of the second embodiment.

The purpose of the second embodiment is to enable the components of the first embodiment to be utilized as a "table top" music support stand (i.e. one that could be mounted to a raised surface, such as the top surface of a table of normal height). The three main components of the first embodiment, namely the upper support section 44 and the extension wings 46*a* and 46*b* are employed in the second embodiment in a form identical (or at least substantially identical) to the first embodiment. Accordingly, those three components are simply given numerical designations corresponding to the first component, and will be described only briefly herein. Thus, the right and left extension wings 46*a'* and 46*b'* each comprise a main panel 56', a lower support flange 62', a lower retaining flange 66' and a lower rear retaining lip (not shown). Also, there is an upper retaining flange with a slot (not shown, but corresponding to components 72 and 76 of the first embodiment). The upper support section 44' comprises the middle mounting leg 48' and the horizontally extending arm structure 50'.

Figure 7:
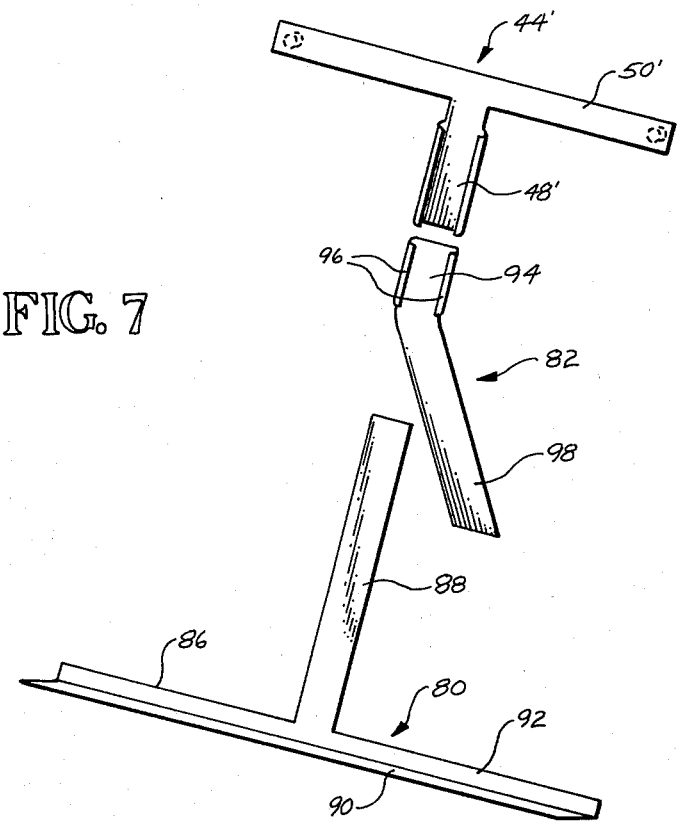
FIG. 7 shows three of the components of a second embodiment of the present invention, these three components being shown spaced from one another.

Reference is now made to FIG. 7, which shows two additional components which are added to make the combination of the second embodiment. These components are: (a) a main support structure 80, (b) a rear support leg 82. The upper support section 44', the rear support leg 82 and the main support structure 80 are shown in FIG. 7 physically separated from one another. These are shown in their assembled position in FIG. 8, with the assembled structure being supported from a top surface from a table top 84.

The main support structure 80 comprises a lower horizontally extending support member 86, and an upwardly extending central support bar 88. The lower member 20 comprises a generally horizontal support flange 90, and a lip member 92 extending upwardly from the rear edge of the flange 90. The central support bar 88 has an elongate generally planar, rectangular configuration. Overall, the main support structure 80 has the configuration of an inverted "T."

The support leg 82 has an upper mounting portion 94 having a pair of gripping lips 96 which engage side edges of the bar 88 to secure the mounting portion 94 to the bar 99. The support leg 82 further comprises a main leg structure 98 which, with the mounting portion 94 secured to the bar 88, extends downwardly and rearwardly from the bar 88.

Figure 8:
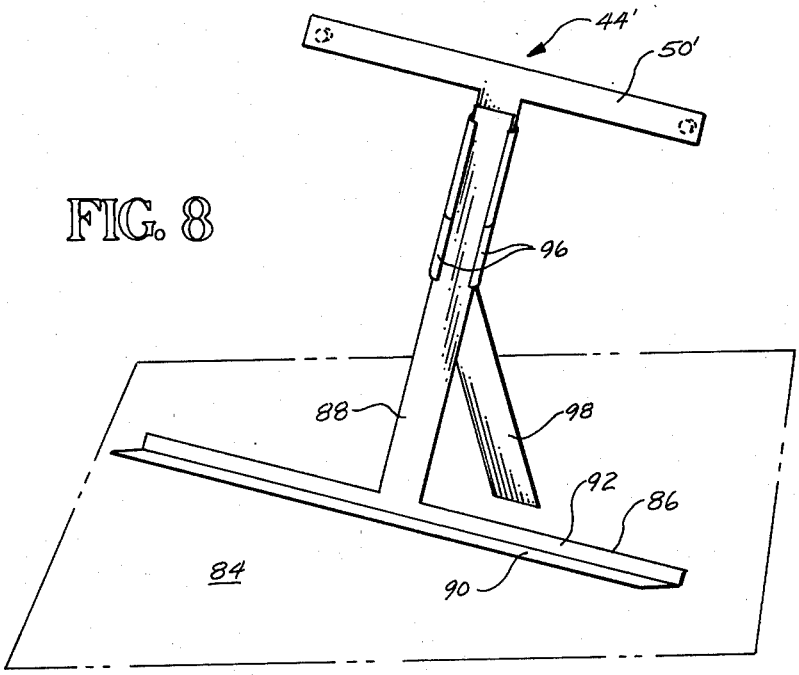
FIG. 8 is a view similar to FIG. 7, but showing the three components of FIG. 7 assembled to one another and resting on a plane surface, such as a table top.

It is readily apparent that with the rear support leg 82 mounted to the main structure 80, these two components 80 and 82 provide a stable support structure, as illustrated in FIG. 8. With the components assembled as shown in FIG. 8, it is also apparent that the right and left extension wings 46*a'* and 46*b'* can now be mounted to this structure, in much the same manner that this is accomplished in the first embodiment. Thus, the lower support member 86 serves substantially the same function as the lower support member 20 of the first embodiment, and fits in sliding engagement with the lower components of the extension 46*a'* and 46*b'*, as shown in FIG. 5. The upper support section 44' engages the upper portions of the two extension wings 46*a'* and 46*b'* in substantially the same manner as the first embodiment. The two extension wings 46*a'* and 46*b'* can be moved together as shown in FIG. 9. To provide more support area, the wings 46*a'* and 46*b'* can be spread outwardly to the position of FIG. 10, in the same manner as in the first embodiment.

It is to be understood that various modifications could be made to the specific apparatus disclosed herein, without parting from the basic concepts incorporated in the present invention.

What is claimed is:

1. An extension apparatus to enlarge the support area of a stand, such as a music stand, said stand having a main central support member and a lower support member extending laterally from the central support member, said apparatus comprising:

a. an upper support section adapted to be mounted to said stand at an upper end thereof, said support section comprising two laterally and oppositely extending support arms, b. a pair of extension wings adapted to be mounted to said stand and to said upper support section, each wing comprising:

1. a panel portion,
2. a lower support flange means adapted to be positioned against the lower support member of the stand,
3. a lower retaining portion adapted to engage said lower support member to permit lateral slide motion between the wing and the lower support member,
4. an upper retaining portion adapted to engage a related support arm to permit lateral slide motion between the wing and the related support arm, whereby with said upper support section mounted to said stand, and with each of the extension wings mounted to the stand and to the upper support section, the two wings can be moved horizontally inward to a middle position, or horizontally outwardly to an expanded position to provide an expanded support area for the stand.

2. The apparatus as recited in claim 1, wherein said support section comprises a middle mounting leg having securing means thereon and adapted to be connected to said main central support member of the stand.

3. The apparatus as recited in claim 2, wherein said securing means comprises a pair of retaining lips adapted to releasably engage edge portions of said main central support member.

4. The apparatus as recited in claim 1, wherein said upper retaining portion of each of the extension wings comprises an upper retaining flange defining a retaining slot to receive a related one of said support arms.

5. The apparatus as recited in claim 4, wherein each of said upper retaining flanges and its related arm is provided with mating stud and slot means to provide a sliding stud and slot connection between the arms and the retaining flanges.

6. The apparatus as recited in claim 1, wherein each lower retaining portion comprises a lower retaining flange positioned below said support flange means and defining with said support flange means a lower slot to receive a support flange of the lower support member of the stand.

7. The apparatus as recited in claim 6, wherein each lower retaining portion further comprises an upstanding lip secured to a rear portion of said retaining flange, with said retaining flange and said lip defining an angled slot to receive the lower support member of said stand.

8. The apparatus as recited in claim 1, wherein a. said support section comprises a middle mounting leg having securing means thereon and adapted to be connected to said main central support member of the stand, b. said securing means comprises a pair of retaining lips adapted to releasably engage edge portions of said main central support member, c. said upper retaining portion of each of the extension wings comprises an upper retaining flange defining a retaining slot to receive a related one of said support arms, d. each of said upper retaining flanges and its related arm is provided with mating stud and slot means to provide a sliding stud and slot connection between the arms and the retaining flanges.

9. The apparatus as recited in claim 1, wherein a. said support section comprises a middle mounting leg having securing means thereon and adapted to be connected to said main central support member of the stand, b. said securing means comprises a pair of retaining lips adapted to releasably engage edge portions of said main central support member, c. said upper retaining portion of each of the extension wings comprises an upper retaining flange defining a retaining slot to receive a related one of said support arms.

d. each of said upper retaining flanges and its related arm is provided with mating stud and slot means to provide a sliding stud and slot connection between the arms and the retaining flanges, e. each lower retaining portion comprises a lower retaining flange positioned below said support flange means and defining with said support flange means a lower slot to receive a support flange of the lower support member of the stand, f. each lower retaining portion further comprises an upstanding lip secured to a rear portion of said retaining flange, with said retaining flange and said lip defining an angled slot to receive the lower support member of said stand.

10. In combination with a stand, such as a music stand, said stand comprising:

a. a lower horizontally extending support member comprising a horizontal support flange adapted to support a lower edge portion of an object to be supported, b. a vertical main central support bar extending upwardly from said horizontally extending support member, the improvement comprising an extension apparatus to enlarge support area of the stand, said extension apparatus comprising:

a. an upper support section adapted to be mounted to said bar, said support section comprising two laterally and oppositely extending support arms, b. a pair of extension wings adapted to be mounted to said lower support member and to said upper support section, each wing comprising:

1. a panel portion,
2. a lower wing support flange adapted to be positioned against the support flange of the stand,
3. a lower retaining flange positioned below the wing support flange and defining therewith a lower retaining slot to receive the support flange of the stand,
4. an upper retaining flange positioned rearwardly of an upper portion of said panel to define an upper retaining slot to receive a related one of said support arms, whereby with said upper support section mounted to said support bar, an with each of the extension wings mounted to the related support arm and lower support member, the two wings can be moved horizontally inwardly to a middle position, or horizontally outwardly to an expanded position to provide an expanded support area for the stand.

11. The apparatus as recited in claim 10, wherein said support section comprises a middle mounting leg having securing means thereon and adapted to be connected to said main central support member of the stand.

12. The apparatus as recited in claim 11, wherein said securing means comprises a pair of retaining lips adapted to releasably engage edge portions of said main central support member.

13. The apparatus as recited in claim 10, wherein each of said upper retaining flanges and its related arm is provided with mating stud and slot means to provide a sliding stud and slot connection between the arms and the retaining flanges.

14. The apparatus as recited in claim 10, wherein each lower retaining portion further comprises an upstanding lip secured to a rear portion of said retaining flange, with said retaining flange and said lip defining an angled slot to receive the lower support member of said stand.

15. An extendable stand assembly, such as a music stand assembly, particularly adapted for use as a table mounted stand assembly, said stand assembly being characterized in that it can be expanded to enlarge support area of the stand assembly, said stand assembly comprising:

a. a main support member comprising:

1. a lower horizontal support member comprising a horizontal support flange adapted to support a lower edge portion of an object to be supported,
2. a support bar extending upwardly from said lower horizontal support member, b. an upper support section adapted to be mounted to said upwardly extending support bar, said support section comprises two laterally and oppositely extending support arms, c. a pair of extension wings adapted to be mounted to said lower support member and to said upper support section, each wing comprising:

1. a panel portion,
2. a lower wing support flange adapted to be positioned against the support flange of the main support member,
3. a lower retaining portion adapted to engage said lower support member to permit lateral slide motion between the wing and the lower support member,
4. an upper retaining portion adapted to engage a related support arm to permit lateral slide motion between the wing and the related support arm, whereby with said upper support section mounted to the upwardly extending support member, and with each of the extension wings mounted to the lower support member and a related support arm, the two wings can be moved horizontally inwardly to a middle position, or horizontally outwardly to an expanded position to provide an expanded support area for the stand.

16. The assembly as recited in claim 15, wherein said support section comprises a middle mounting leg having securing means thereon and adapted to be connected to the support bar of the stand.

17. The assembly as recited in claim 16, wherein said securing means comprises a pair of retaining lips adapted to releasably engage edge portions of said support bar.

18. The assembly as recited in claim 15, wherein said upper retaining portion of each of the extension wings comprises an upper retaining flange defining a retaining slot to receive a related one of said support arms.

19. The assembly as recited in claim 18, wherein each of said upper retaining flanges and its related arm is provided with mating stud and slot means to provide a sliding stud and slot connection between the arms and the upper retaining flanges.

20. The assembly as recited in claim 15, wherein each of said lower retaining portions comprises a lower retaining flange positioned below the support flange of the wing, and defining with the support flange of the wing a lower slot to receive the support flange of the lower support member.

21. The assembly as recited in claim 20, wherein each lower retaining portion further comprises an upstanding lip secured to a rear portion of the retaining flange, with the retaining flange and the lip defining an angle slot to receive the lower support member.

22. The assembly as recited in claim 15, wherein said main support member has a general configuration of an inverted "T," and said support bar is centrally positioned to extend upwardly from a middle portion of the lower horizontal support member.

23. The assembly as recited in claim 16, further comprising a leg member adapted to be releasably attached to said main support member in a manner to extend downwardly and rearwardly from the support bar to provide stable support from a base surface.

24. The assembly as recited in claim 15, wherein:

a. said support section comprises a middle mounting leg having securing means thereon and adapted to be connected to the support bar of the stand, b. said securing means comprises a pair of retaining lips adapted to releasably engage edge portions of said support bar, c. said upper retaining portion of each of the extension wings comprises an upper retaining flange defining a retaining slot to receive a related one of said support arms, d. each of said upper retaining flanges and its related arm is provided with mating stud and slot means to provide a sliding stud and slot connection between the arms and the upper retaining flanges.

25. The assembly as recited in claim 16, wherein:

a. said support section comprises a middle mounting leg having securing means thereon and adapted to be connected to the support bar of the stand, b. said securing means comprises a pair of retaining lips adapted to releasably engage edge portions of said support bar, c. said upper retaining portion of each of the extension wings comprises an upper retaining flange defining a retaining slot to receive a related one of said support arms, d. each of said upper retaining flanges and its related arm is provided with mating stud and slot means to provide a sliding stud and slot connection between the arms and the retaining flanges, e. each of said lower retaining portions comprises a lower retaining flange positioned below the support flange of the wing, and defining with the support flange of the wing a lower slot to receive the support flange of the lower support member, f. each lower retaining portion further comprises an upstanding lip secured to a rear portion of the retaining flange, with the retaining flange and the lip defining an angle slot to receive the lower support member, g. said main support member has a general configuration of an inverted "T," and said bar is centrally positioned to extend upwardly from a middle portion of the lower horizontal support member.

* * * * *